US005404654A

United States Patent [19]

Babinsky et al.

[11] Patent Number: 5,404,654

[45] Date of Patent: Apr. 11, 1995

[54] CHAMBERED NIP DRYING OF PAPERBOARD WEBS

[75] Inventors: Vladislav A. Babinsky, Spring Valley; Warren G. Mumford, Cornwall-on-Hudson, both of N.Y.

[73] Assignee: International Paper Company, Purchase, N.Y.

[21] Appl. No.: 52,981

[22] Filed: Apr. 27, 1993

[51] Int. Cl.[6] ..... D21F 3/02; F26B 11/02

[52] U.S. Cl. ..... 34/122; 162/206; 162/359.1; 34/454; 34/629; 34/634

[58] Field of Search ..... 34/273, 274–414, 34/444, 454, 493, 494, 611, 618, 620, 629, 634, 114, 115, 116, 117, 120, 123, 122; 162/206, 207, 290, 359.1, 375

[56] References Cited

U.S. PATENT DOCUMENTS

| | | | |
|---|---|---|---|
| 1,691,930 | 11/1928 | Montgomery | 34/68 |
| 1,726,834 | 9/1929 | Hopkins | 34/444 |
| 2,197,463 | 4/1940 | Bradner | 34/122 |
| 2,208,511 | 7/1940 | Ellis | 162/206 |
| 2,355,391 | 8/1944 | Nelson | 34/68 |
| 2,370,811 | 3/1945 | Osgood | 92/68 |
| 2,456,301 | 12/1948 | Miller | 34/18 |
| 3,281,952 | 8/1963 | Mullaney | 34/41 |
| 3,560,333 | 2/1971 | Douglas et al. | 162/206 |
| 3,639,207 | 2/1972 | Genz | 162/146 |
| 3,938,261 | 2/1976 | Anderson | 34/114 |
| 4,163,688 | 8/1979 | Kan Kaanpaa | 162/359 |
| 4,188,731 | 2/1980 | Rauskolb | 34/41 |
| 4,249,992 | 2/1981 | Wells | 162/198 |
| 4,272,316 | 6/1981 | Justus | 162/206 |
| 4,351,700 | 9/1982 | Dove | 162/252 |
| 4,506,457 | 3/1985 | Lehtinen | 34/41 |
| 4,658,716 | 4/1987 | Boissevain | 100/38 |
| 4,942,675 | 7/1990 | Sundouist | 34/23 |

FOREIGN PATENT DOCUMENTS 874840 8/1961 United Kingdom

*Primary Examiner*—Henry A. Bennet
*Assistant Examiner*—William C. Doerrler
*Attorney, Agent, or Firm*—Michael J. Doyle

[57] ABSTRACT

A paper web impulse drying apparatus and method. A paper or paperboard web, typically of indefinite length, is treated after issuing from a Fourdrinier or other paper making apparatus by passing it through the nip of a pair of rolls, at least one of which is heated. The rolls both compress the web and raise it to a relatively high temperature. Such treatment enhances certain properties of the web. Web delamination due to flashing of superheated water, after the web leaves the nip, is prevented by both (a) a steam chamber on the exit side of the nip through which the web passes, and (b) heating the web prior to its entrance into the nip. This permits lower roll temperatures to be employed, thereby decreasing the magnitude of the sudden decrease in pressure experienced by the web as it exits from the roll nip. By preheating the sheet and passing it through the steam chamber, the temperature of the heated drying roll or rolls can be decreased to 120°–150° C., thus decreasing the thickness of the densified layer at that surface of the paper web which is contacted by a heated roll and preventing web delamination caused by flashing.

17 Claims, 3 Drawing Sheets

FIG. 1
(PRIOR ART)
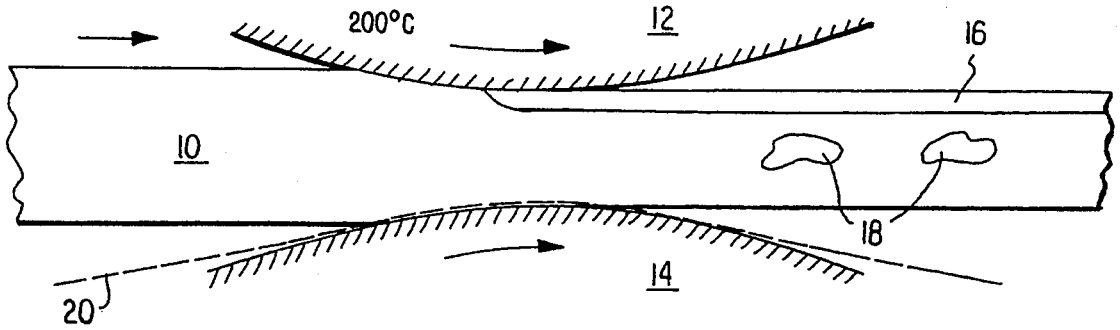
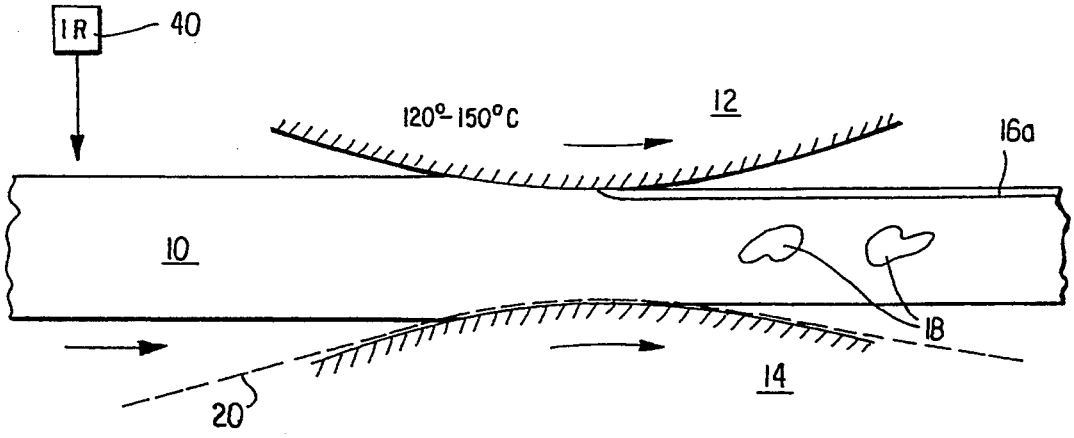
FIG. 2

FIG. 5
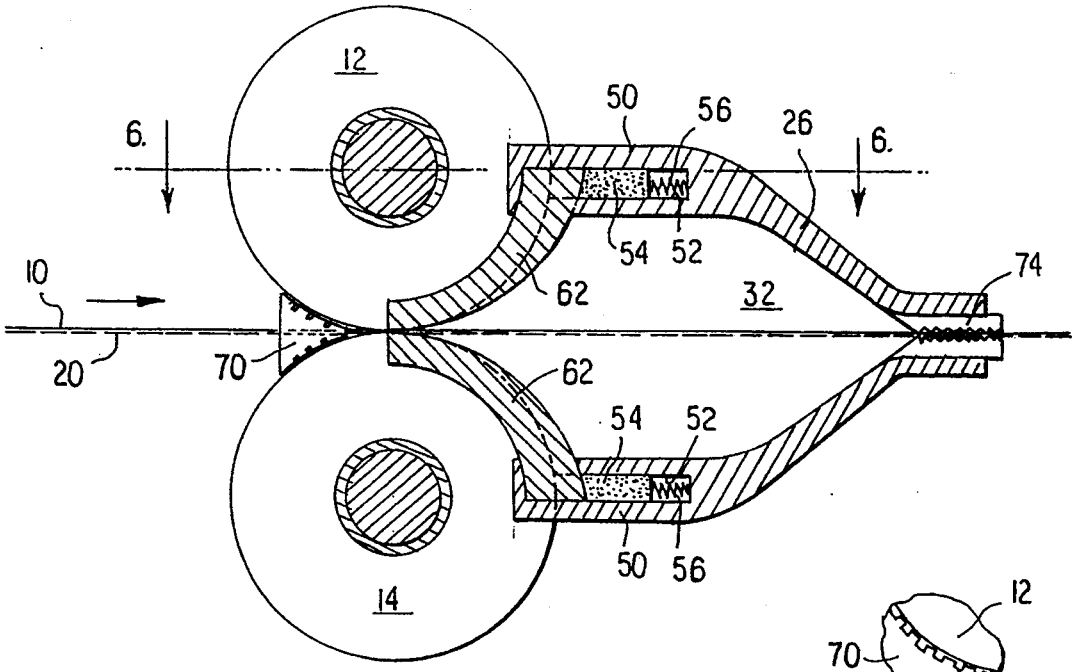
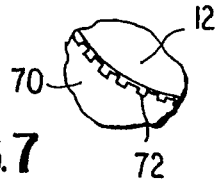
FIG. 7
FIG. 6
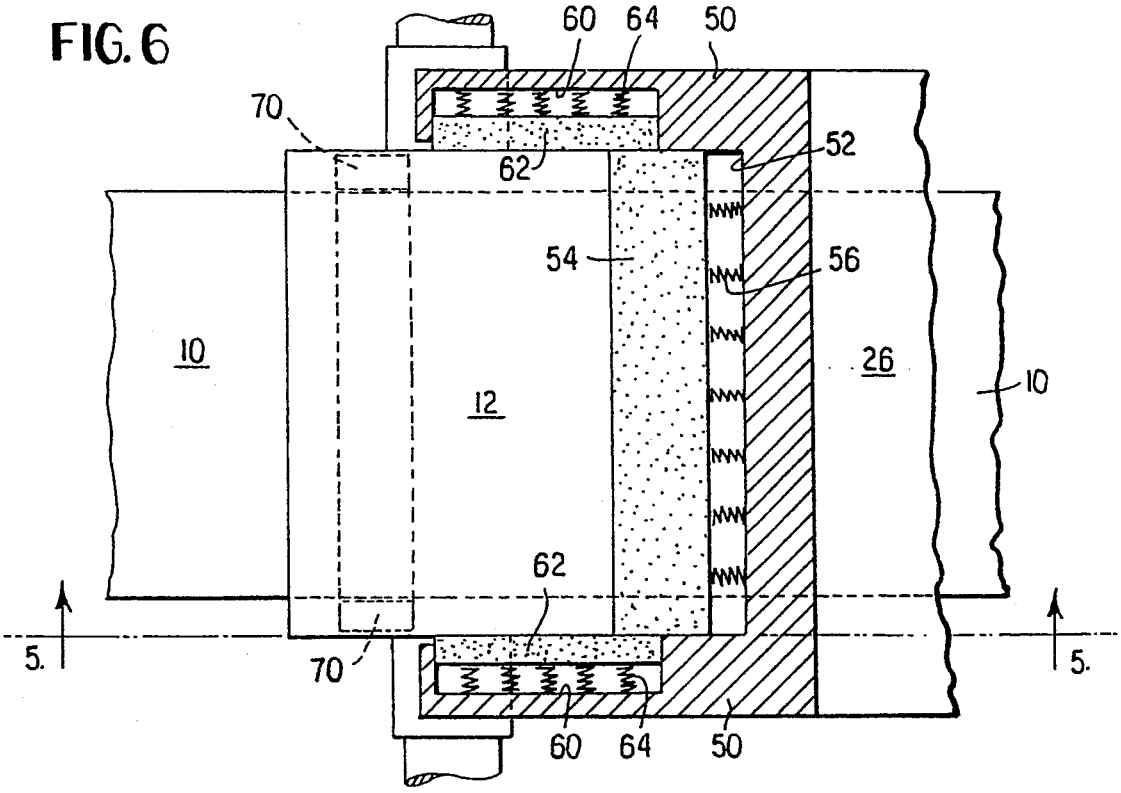

CHAMBERED NIP DRYING OF PAPERBOARD WEBS

BACKGROUND OF THE INVENTION

This invention relates to the art of papermaking and more particularly to impulse drying of paper webs or sheets. With impulse drying, a web of improved properties can be produced, such as densification, high smoothness and increased strength. Impulse drying, although known, has not yet been commercially practical because of the problem of delamination.

After a paper or paperboard web is formed, as by a Fourdrinier apparatus, it is passed through a number of roll pairs, the rolls usually unheated, to remove water by mechanical pressing and is then contacted by a heated roll to remove water by evaporation. A known treatment to increase strength is to pass a paper web, typically of indefinite length, through one or more heated roll pairs, the rolls typically compressing the web to 70%–80% of its original thickness. Only one roll of the roll pair is usually heated. The heated roll is of a temperature approximately 200° C. An endless porous felt is usually located in the nip and passes around the unheated roll. The combination of heat and pressure exerted on the web by the nip of the rolls works or functions to increase web strength. However, it has been observed that such treatment, termed impulse drying, has the undesirable effect of delaminating the web. This is due to the fact that the web becomes very hot upon contact with the heated roll in the nip of the roll pair. While the web is under pressure in the nip, heat energy from the heated roll raises the temperature of the water within the web to a significantly high value, such high temperature water termed superheated water. Upon exiting from the nip, the roll pressure on the web is suddenly released, with the consequence that the moisture within the web has a tendency to flash and cause delamination of the paper web. Further, the relatively high roll temperature causes significant densification of the web surfaces which is in contact with the heated roll, thus creating a barrier to the escape of the vaporized, superheated water within the web.

Sheet or web delamination has been a major obstacle to the commercialization of impulse drying technology.

SUMMARY OF THE INVENTION

According to the practice of this invention, the exit zone of the nip of a pair of rolls for papermaking, usually only one of the rolls being heated, is provided with a chamber, the chamber having one or more jets for the introduction of steam or hot air therein. The chamber is termed a post nip chamber. The pressure in the chamber is a greater than atmospheric pressure. The steam increases the partial vapor pressure in the exit zone of the nip, i.e., within the post nip chamber. An increase in the partial pressure of the steam around the web causes a decrease in the rate of evaporation of web moisture after the web leaves the nip. A significant decrease in the rate of evaporation eliminates flashing and hence eliminates delamination. The total pressure in the post nip chamber cavity is typically from one to two atmospheres and its temperature therein 110° C. or more. The forward or upstream ends of the chamber preferably carry seals engagable with the rolls to facilitate such higher than atmospheric pressure therein. Similarly, the rear or downstream end of the chamber is preferably provided with a seal through which the web exits.

The chamber decreases in transverse cross section with increasing distance downstream from the nip. Because of this decrease, the injected steam (or air) velocity increases in the direction of web exiting from the chamber, with a consequent decrease in pressure along this direction.

An infrared (IR) heater is positioned in front of the nip and preheats the moving web before it enters the nip. This provides higher than ambient temperature of the web or sheet when the web enters the nip. Preheating the web makes it possible to keep the temperature of the heated roll in the range 120–150° C., as opposed to about 200° C. as in conventional impulse drying processes/apparatus. Such preheating prevents the surface of the sheet from excessive densification due to the usual 200° C. temperature of the heated roll, and allows the water vapor from the web to pass through the relatively less densified surface layer of the sheet more easily after it exits the nip. The temperature of the sheet after IR preheating is around 100–110° C.

Another advantage of infrared preheating is the penetration of the radiation completely through the sheet to uniformly heat it. To achieve this uniform heating, a wavelength of between 1.5–3.5 microns is employed.

The infrared heater may optionally be connected to the post nip steam chamber through a feedback or automatic control system which provides a change of the temperature and the pressure of the steam injected into the chamber, if the amount of heat supplied by the infrared heater changes. Namely, more heat radiated from the infrared heater requires more steam in the chamber to increase the steam partial vapor pressure and to slow down the evaporation of web moisture from the sheet. Such a feedback connection is not essential for the practice of this invention.

BRIEF DESCRIPTION OF THE DRAWINGS

FIG. 1 is a partial longitudinal sectional view schematically illustrating the surface densification effect on a paper web in a typical prior impulse drying apparatus and method.

FIG. 2 is a view similar to FIG. 1 and schematically illustrates the action of the infrared pretreatment and roll treatment of this invention.

FIG. 5 is a partial schematic side elevational view of the apparatus of FIG. 3 showing details of the seals of FIG. 3.

FIG. 6 is a view taken along section 6—6 of FIG. 5.

FIG. 7 is a magnified view of a seal of FIG. 5.

DETAILED DESCRIPTION OF THE INVENTION

Figure 3:
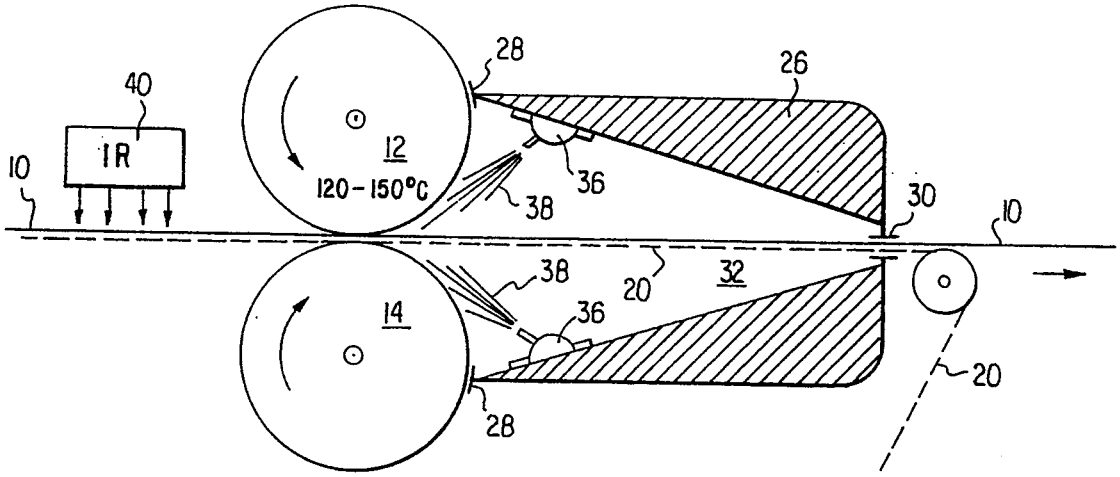
FIG. 3 is a partial schematic longitudinal sectional view of an impulse drying apparatus and method of this invention.

Referring now to FIG. 1 of the drawings, a typical known impulse drying apparatus and process is illustrated. A paper web 10, travelling from left to right from a papermaking machine or from a series of preliminary web treating rolls, is illustrated as passing through the nip of two rolls 12 and 14, roll 12 being heated by any conventional means to a temperature of approximately 200° C. The incoming web 10 is compressed in passing through the nip to about 70 to 80 percent of its original thickness. Upon contacting the heated roll 12, the surface of the web undergoes densification, illustrated schematically by band 16 on that web surface which contacts roll 12. The water or moisture in the web is designated as 18. When entering the nip, web 10 is approximately 30 to 60 percent in dryness. An endless felt web 20, schematically shown passes over unheated roll 14.

At the nip, the web is subject to increased pressure and increased temperature, with respect to ambient, with this combination often superheating the water or moisture within the web. After passing through the nip, the now superheated web moisture has a tendency to flash or rapidly vaporize due to sudden decrease in pressure. Such rapid or flash vaporization of the moisture in the web often causes web delamination. Further, the densified layer 16 on the surface of the web acts as a partial barrier to the escape of the now vaporized moisture. This introduces another impediment to the escape of vapor from the interior of the web.

Referring now to FIG. 2 of the drawings, a similar schematic longitudinal cross section of the web and roll pair is illustrated according to the practice of this invention, but without post nip chamber 26, the latter to shortly be described. The web 10 is preheated by an infrared heater 40 just prior to its entry into the nip between rolls 12 and 14, the latter provided with a conventional felt 20. The wave length of the radiation emanated by 40 is in the range of 1.5–3.5 microns. This raises the temperature of the web, uniformly, to about 110° C. Again, the web 10 is compressed to about 70 to 80 percent of its original thickness in passing through the nip, with the heated roll 12 now at a lower temperature of between 120°–150° C. A densified layer is formed on the surface of the paper web which contains heated roll 12, such a layer denoted as 16*a*. The moisture or water in the web is again designated as 18. Because the roll temperature is significantly lower, the thickness and density of densified layer 16*a*, with the practice of this invention, is less than that of densified layer 16. This permits easier flow or escape of internal water vapor from the web. Further, because of the lower temperature of heated roll 12, the moisture within the web is not superheated to the same degree and hence delamination due to flashing of superheated water in the web is effectively precluded.

Turning now to FIG. 3 of the drawings, a specific installation of an impulse drying apparatus and method according to the practice of this invention is partially schematically illustrated. Again, a paperboard web coming from a Fourdrinier or other papermaking machine is designated as 10 and passes from left to right through the nip of rolls 12 and 14. Typically, endless porous felt 20 lies beneath and partially supports web 10, as is conventional. Again, an infrared radiant heater 40 directs radiation of a wave length of between 1.5 and 3.5 microns against web 10. By selecting this range of wave lengths, uniformity of heating of the web throughout its thickness is obtained. The temperature of the web is raised to approximately 110° C. by the infrared radiation. The dryness of web 10 prior to its passage between heated rolls 12 and 14 is typically 30–60 percent.

A post nip steam chamber 26, typically of metal, and of generally triangular longitudinal cross section is provided around its entrance mouth with seals 28. The other or exit end of steam chamber 26 is provided with a seal 30 through which web 10 and felt 20 exit. The interior cavity of chamber 26 is designated as 32. One or more steam nozzles or jets 36 is provided in chamber 26 so as to inject steam designated as 38 into the interior 32, the source of steam not shown. The jets typically direct the steam flow towards the nip. Seals 28 and 30 assist in maintaining the pressure within interior cavity 32 at approximately two atmospheres. Upon exiting from chamber 26, web 10 is of a dryness of about 50–70 percent. It is seen that by virtue of the taper of the interior cavity 32 there is an increase in velocity of steam exiting through downstream or rear seal 30, with a consequent gradual decrease in pressure in the downstream direction. This follows from well known principles of hydrodynamics.

Figure 4:
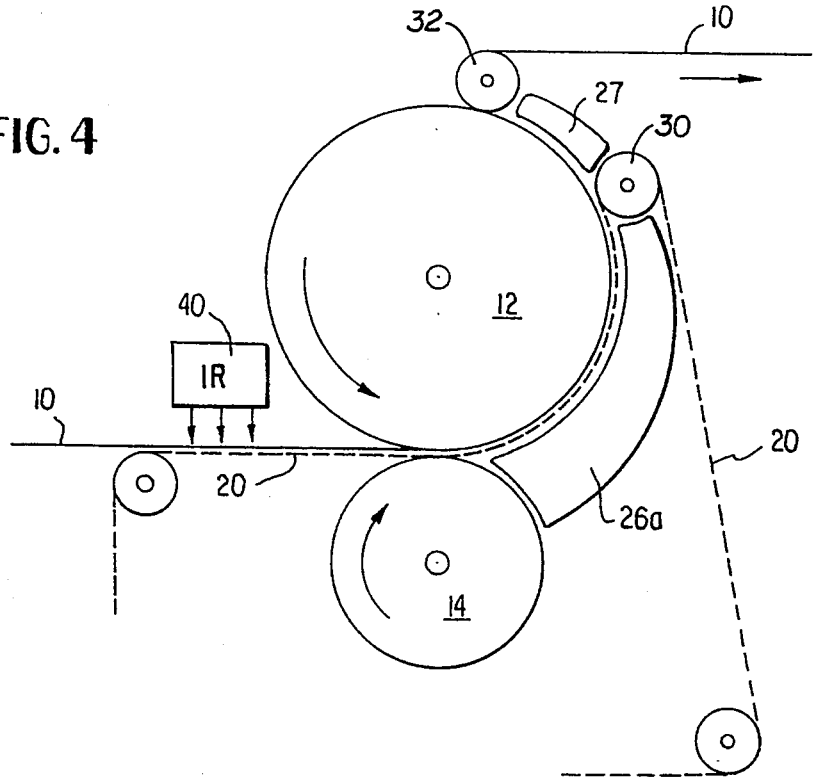
FIG. 4 is a view of a modification of the apparatus and method of FIG. 2.

Referring now to FIG. 4 of the drawings, a different configuration of the elements shown at FIG. 3 is illustrated, with similar reference numerals designating similar elements.

The configuration of FIG. 4 contemplates that the endless felt 20 encompasses and contacts a significant angular portion of the surface of heated roll 12, under first chamber 26*a*, as does web 10. After such surface contact, felt 20 leaves the surface by passing over roll 30. Web 10 continues in roll surface contact and under second steam chamber 27, after which it leaves the roll surface by passing over roll 32 for further treatment or processing. The two post nip steam chambers 26a and 27 are generally U shaped in transverse cross section, with their open portions directed radially inwardly to provide a high pressure, high temperature steam atmosphere to the felt and web therebeneath, similar to the atmosphere provided by interior cavity 32 of FIG. 3. The dual chamber configuration of FIG. 4 permits the use of a simplified configuration of the seals which contact the surface of the felt. The pressure in the two chambers decreases gradually from their respective entrance to their respective exit or terminal portions. The average pressure in the first chamber 26*a* can be greater than in the second chamber 27. The gradual decrease of pressure in each chamber can provide better opportunity to inhibit delamination. The time of the pressure-temperature treatment will increase in this configuration, contributing to improvement of web strength properties.

Referring now to FIGS. 5 and 6, a partially schematic seal configuration is illustrated for seals 28 and 30 of FIG. 3. The forward or upstream ends of chamber 26 are provided with recesses 52 in which respective bars 54 of a low coefficient of friction are located. Any material having low surface friction may be used, as for example Teflon, a brand of polytetraflurothylene. Coil or other springs 56 act to resiliently urge one surface of each Teflon bar against a peripheral surface portion of a respective roll 12, 14, in a generally radial direction. The ends of curved Teflon bars 62 are mounted in other, respective, recesses 60 in the forward end 50 of chamber 36. Bars 62, at their ends remote from the nip and the web 10, are resiliently urged towards the ends of respective rolls 12, 14, by coil or other springs 64. Each of a pair of generally triangular Teflon blocks 70 is mounted (by brackets not shown) at respective sides of the web, upstream of the nip. The somewhat curved sides of blocks 70 sealingly engage respective curved surfaces of the rolls. Teflon end seals 74 seal web 10 as it exits from the chamber.

FIG. 7 illustrates transverse grooves 72 in the curved surfaces of block 70 which engages roll 12, the other roll 14 being similarly engaged. The specific form and construction of seals 28 and 30 plays no role in the invention.

We claim:

1. An impulse drying apparatus for the treatment of a paper or paperboard web, the apparatus including a pair of rolls having a nip between them, at least one of said rolls being heated, a steam chamber housing having a cavity therein, said housing located next to said nip and on the downstream side of said nip, said steam chamber housing having an inlet end in contiguous relation to said roll pair, said steam chamber housing having an apertured downstream outlet end to permit a paper web to pass therethrough, at least one steam jet feeding said steam chamber cavity, a seal at the inlet end of said steam chamber housing, said seal engaging said pair of rolls, said rolls and said housing forming an interior cavity for receiving steam.

2. The apparatus of claim 1 wherein said cavity is tapered in longitudinal cross section to define a cavity of progressively less transverse cross section in passing from the downstream end of said nip towards said cavity outlet end.

3. The apparatus of claim 1 including a heater located on the side of said nip opposite to said steam chamber housing.

4. The apparatus of claim 1 wherein said apertured outlet end of said steam chamber housing is provided with a seal through which a paperboard web is adapted to pass.

5. An impulse drying apparatus for the treatment of a paper or paperboard web, the apparatus including a pair of rolls having a nip between them, at least one of said rolls being heated, a pair of steam chamber housings each curved and angularly spaced around a circumferential portion of said heated roll surface and radially outwardly spaced therefrom, at least a third roll, said third roll positioned between said two steam chamber housings, each of said steam chamber housings being generally U-shaped in transverse cross section whose open portions facing the surface of said heated roll, one of said pair of steam chamber housings having an end contiguous to said nip, a seal at the inlet end of said one steam chamber housing, said seal engaging said pair of rolls, said rolls and said one housing forming an interior cavity for receiving steam.

6. A method of continuous impulse drying a web of paper to increase its strength, the web having a moisture content, the method including the steps of, continuously advancing the paper web through the upstream side of the nip of a pair of rolls, at least one of said rolls being heated, to thereby subject the web to an increase in pressure and temperature while in the nip, surrounding the paper web at the downstream side of said nip with a steam chamber, said steam chamber having an inlet end in contiguous relation to the nip of said rolls and having a slotted outlet end through which said web passes out of said steam chamber, said rolls forming a portion of said steam chamber, passing steam into said steam chamber, whereby the rate of change of web pressure, moisture, and temperature during web movement downstream after exiting from the nip are decreased, to thereby inhibit delamination of the web caused by flashing of the web moisture.

7. The method of claim 6 including the additional step of preheating said paper web immediately prior to entering the nip.

8. The method of claim 7 wherein said preheating is radiant infrared heating at a wavelength of between 1.5 and 3.5 microns.

9. The method of claim 6 wherein the temperature of said at least one heated roll is about 120 to 150 degrees C.

10. The method of claim 8 wherein the web is uniformly heated to a temperature of about 100 to 110 degrees C.

11. The method of claim 6 wherein the pressure within said steam chamber is above atmospheric.

12. A method of continuous impulse drying a web of paper to increase its strength, the web having a moisture content, the method including the steps of, continuously advancing the paper web through the nip of a pair of rolls, at least one of said rolls being heated, to thereby subject the web to an increase in pressure while in the nip, partially surrounding the paper web at the downstream side of said nip with first and second steam chamber housings of generally U-shaped transverse cross section, said housings angularly spaced around the circumferential surface of said, passing steam into said steam chamber, a seal at the inlet end of one of said steam chamber housings, said seal engaging said pair of rolls, said rolls and said one housing forming an interior cavity for receiving steam, to thereby subject the web to an increase in pressure and temperature as the web remains in contact with a portion only of the circumferential surface of said heated web, whereby the rate of change of web moisture temperature during web movement downstream after exiting from the nip is decreased, to thereby inhibit delamination of the web caused by flashing of the web moisture.

13. The method of claim 12 including the additional step of preheating said paper web immediately prior to entering the nip.

14. The method of claim 13 wherein said preheating is radiant infrared heating at a wavelength of between 1.5 and 3.5 microns.

15. The method of claim 12 wherein the temperature of said at least one heated roll is about 120 to 150 degrees C.

16. The method of claim 15 wherein the web is uniformly heated to a temperature of about 100 to 110 degrees C.

17. The method of claim 12 wherein the pressure within said first and second steam chambers is above atmospheric.

* * * * *